US006302256B1

(12) United States Patent
Ito et al.

(10) Patent No.: US 6,302,256 B1
(45) Date of Patent: Oct. 16, 2001

(54) COIN HANDLING DEVICE

(75) Inventors: Yukio Ito, Saitama; Masato Yagi, Urawa; Nobuyuki Iida; Tetsuro Kikuchi, both of Tsurugashima; Kenji Nakajima, Saitama, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/424,129

(22) PCT Filed: Mar. 17, 1999

(86) PCT No.: PCT/JP99/01301

§ 371 Date: Nov. 18, 1999

§ 102(e) Date: Nov. 18, 1999

(87) PCT Pub. No.: WO99/48061

PCT Pub. Date: Sep. 23, 1999

(30) Foreign Application Priority Data

Mar. 18, 1998 (JP) ..... 10-068627
Mar. 18, 1998 (JP) ..... 10-068628

(51) Int. Cl.[7] ..... G07F 1/04; G07F 9/10
(52) U.S. Cl. ..... 194/348; 194/350
(58) Field of Search ..... 194/347, 348, 194/349, 350

(56) References Cited

U.S. PATENT DOCUMENTS 5,027,937 * 7/1991 Parish et al. ..... 194/348
5,597,061 1/1997 Nishiumi et al. ..... 194/348
5,605,214 * 2/1997 Yukimoto et al. ..... 194/348
5,794,755 * 8/1998 Reese et al. ..... 194/348

FOREIGN PATENT DOCUMENTS 1-061778 4/1989 (JP) .
1-61777 4/1989 (JP) .
1-311396 12/1989 (JP) .
2-076092 3/1990 (JP) .
2-076093 3/1990 (JP) .
4-144689 6/1990 (JP) .
4-033194 2/1992 (JP) .

* cited by examiner

*Primary Examiner*—Robert P. Olszewski
*Assistant Examiner*—Bryan Jaketic
(74) *Attorney, Agent, or Firm*—Hogan & Hatson, L.L.P.

(57) ABSTRACT

A coin handling device, as a first invention, comprising a cable (20), a liquid guide means (61) for guiding liquid falling via a cable guide hole (10*a*) into a device body (2), a liquid storing means (62) and a liquid discharging means (63). A coin handling device, as a second invention, wherein a coin selection unit (101, 201) comprising a coin guide means (181), a liquid collecting means (182) and a liquid discharging means (183) is equipped with a liquid flow-in means (184) for allowing liquid falling via the coin guide means (181) to flow into those portions of the coin selection unit (101, 201) other than the liquid sorting means (182), a liquid passing means (185) and a liquid flowout means (186, 216) for continuously feeding the passed liquid to the liquid discharging means (183).

7 Claims, 12 Drawing Sheets

COIN HANDLING DEVICE

TECHNICAL FIELD

The present invention relates to a coin handling device for use in automatic vending machines, money changing machines, self-service machines and the like, which sorts and stores inserted coins according to their denomination, and dispenses the sorted and stored coins as change.

Automatic vending machines, money changing machines, self-service machines and similar facilities are conventionally fitted with a coin handling device, which sorts and stores inserted coins according to their denomination, and dispenses the sorted and stored coins as change.

Broadly speaking, this coin handling device comprises the following three sections.

The first section is the body of the device, which constitutes the casing of the coin handling device. At the very bottom of the body of the device is located a coin dispenser unit which serves to dispense change.

The second section is a coin storage unit, located directly above the coin dispenser unit and storing coins which have been sorted by denomination. The coin storage unit comprises a plurality of coin tubes, and is fitted to the body of the device in such a manner as to be capable of being attached and detached freely.

The third section is a coin sorting unit, which is located directly above the coin storage unit and serves to sort the inserted coins into authentic ones or counterfeit ones and sorts the authentic coins according to the denominations.

The coin sorting unit has a complex system of coin passages which serve to identify coins inserted through the coin insertion aperture as authentic or counterfeit, and to sorts the coins identified as authentic according to the denominations. In some parts of this complex system of coin passages is located a variety of coin-sorting machinery, including coin identification devices comprising oscillation coils and reception coils, a plurality of levers which serve to sort the coins into the prescribed coin passages, and solenoids which serve to drive them.

With a coin handling device structured in this manner, inserted coins first enter the coin sorting unit. Here, as they roll along the respective prescribed coin passages, they are identified as authentic or counterfeit, and the authentic coins are sorted by denomination. Counterfeit coins are channelled into a prescribed coin passage, while authentic coins are each sorted and guided into prescribed coin passages formed according to denomination. The authentic coins are then stored by denomination in the coin storage unit. When the denominations which constitute the required change are determined, coins which have been stored in the coin storage unit are selected according to the amount of change required, and dispensed through a coin dispensing unit located at the very bottom.

Within the casing which constitutes the body of the coin handling device are located various types of electronic equipment including a pay-out slide which dispenses the coins, a motor which drives the pay-out slide, and solenoid plungers. A problem exists here in that if, for instance, detergent or a similar viscous liquid drops down into the interior from the upper surface of the casing which constitutes the body of the device, this may penetrate the various members which constitute the coin handling device, adhering to the solenoids and other pieces of electronic equipment or the various pieces of driving machinery, causing them to malfunction and thereby impair the function of the coin handling device. A further problem is that when viscous liquid adhering to such machinery dries, it can act as a lock preventing the machinery from operating, and thus halt the function of the coin handling device altogether.

In the coin sorting unit in particular, due to the complex formation of coin passages within the body of the device and the fact that the coins roll along these coin passages, if soft drinks or detergent and similar liquids are allowed in, this liquid will also run along the coin passages and penetrate the interior of the device.

The fear is that if detergents and similar viscous liquids are allowed into the coin passages, they will adhere to the coin sorting levers and other sorting apparatus which is located in these coin passages, causing them to malfunction and impair the sorting function.

There is a further problem in that not only can viscous liquid adhering to the sorting apparatus dry and act as a lock preventing the sorting apparatus from operating, thus halting the function of the coin handling device, but it can also penetrate as far as the coin tubes where the authentic coins are stored after sorting by denomination. This may cause the electronic circuitry, motors and other electrical components located in that vicinity to be short-circuited and malfunction.

Numerous suggestions have been made for the provision of liquid discharging means at various points in a coin handling device.

However, it has proved especially difficult to eliminate liquid flowing along the cables which run into the coin handling device from outside, feeding signals and electric power to it.

The applicant of the present invention has previously proposed a method of preventing liquid from penetrating the coin passages formed within the coin handling device in Japanese Patent Publication 2-76092. According to the proposed coin handling device, liquid guide grooves are provided both on the main plate, where are formed both the coin insertion aperture and the coin passages which connect with the coin insertion aperture and lead roughly vertically downwards, and on the gate plate which serves to open and close the main plate. Liquid penetrating through the coin insertion aperture is swiftly discharged from the device with the aid of the liquid guide grooves together with a liquid collection unit which is provided downstream from the liquid guide grooves, and a liquid discharge passage which connects to the liquid collection unit.

However, even with the provision of liquid guide grooves on the main plate and on the gate plate, and the liquid collection unit downstream from them, the risk remains that large amounts of liquid entering through the coin insertion aperture may overflow from the liquid guide grooves and penetrate the body of the device.

Another risk is that when liquid guide grooves are formed on both the main plate and the gate plate, opening the two plates in order to return coins which have lodged between them may allow the coins to wedge between the liquid guide grooves formed respectively on the main plate and on the gate plate, thus making it impossible to return the coins.

It is therefore an object of the first invention to provide a coin handling device wherein liquid running down the cable and penetrating the interior of the device is swiftly discharged.

Moreover, it is an object of the second invention to provide a coin handling device wherein liquid entering through the coin insertion aperture is not allowed to flow into the body of the device.

DISCLOSURE OF THE INVENTION

The first invention is a coin handling device having at least a coin-sorting unit located within the body of the device, which constitutes its casing, and serving to sort inserted coins into authentic ones and counterfeit ones, characterised in that it is equipped with a cable which serves to feed various signals and electric power; and a cable guide hole, which is formed on the upper surface of the body of the device and into which the cable is inserted; being further equipped with liquid guiding means, the purpose of which is to guide into the body of the device any liquid dropping down the cable and through the cable guide hole; liquid storing means, which serves to store the guided liquid within the body of the device; and liquid discharging means, which serves to discharge the stored liquid from the body of the device.

In this manner it is possible to prevent, as far as is feasible, liquid dropping down along the cable and through the cable guide hole from adhering to the various components within the body of the device, thus providing a coin handling device which will function in a stable fashion over long periods of time, and to guard the coin handling device against pranks involving the pouring of liquid into it.

Meanwhile, the second invention is a coin handling device having at least a coin-sorting unit comprising coin guide means which serves to guide coins inserted by way of a coin insertion aperture downwards roughly vertically, liquid collecting means which serves to collect liquid dropping down the coin guide means, and liquid discharging means which serves to discharge the collected liquid to outside the device, characterised in that the coin-sorting unit is equipped with liquid flow-in means, which allows liquid dropping down the coin guide means to flow into the coin-sorting unit rather than into the liquid collecting means; liquid passing means, which allows large amounts of the liquid which has been allowed to flow in to pass; and liquid flow-out means, which allows the liquid which has been allowed to pass to flow out to the liquid discharging means.

In this manner, even if detergent or a similar viscous liquid is introduced in large amounts through the coin insertion aperture, it is discharged swiftly from the interior of the device by way of the liquid passing means, thus making it possible to prevent, as far as is feasible, liquid introduced through the coin insertion aperture from overflowing from the coin guide means. It is therefore possible, as far as is feasible, to prevent liquid from adhering to the sorting apparatus which is located within the coin sorting unit, thus ensuring continuous stable functioning.

Moreover, by not forming a liquid guide groove on at least one plate from among the main plate and gate plate which constitute the coin guide means, it can be ensured that when the two are opened in order to return coins which have lodged between them, it is possible to do so and return the coins without any of them becoming wedged between the main plate and the gate plate, thus providing a coin handling device having a stable function for the return of lodged coins.

BEST MODE FOR CARRYING OUT THE INVENTION

There follows a detailed description of the present invention with reference to the accompanying drawings.

Embodiments of the coin handling device to which the first and second inventions pertain will be described below in detail.

Figure 1:
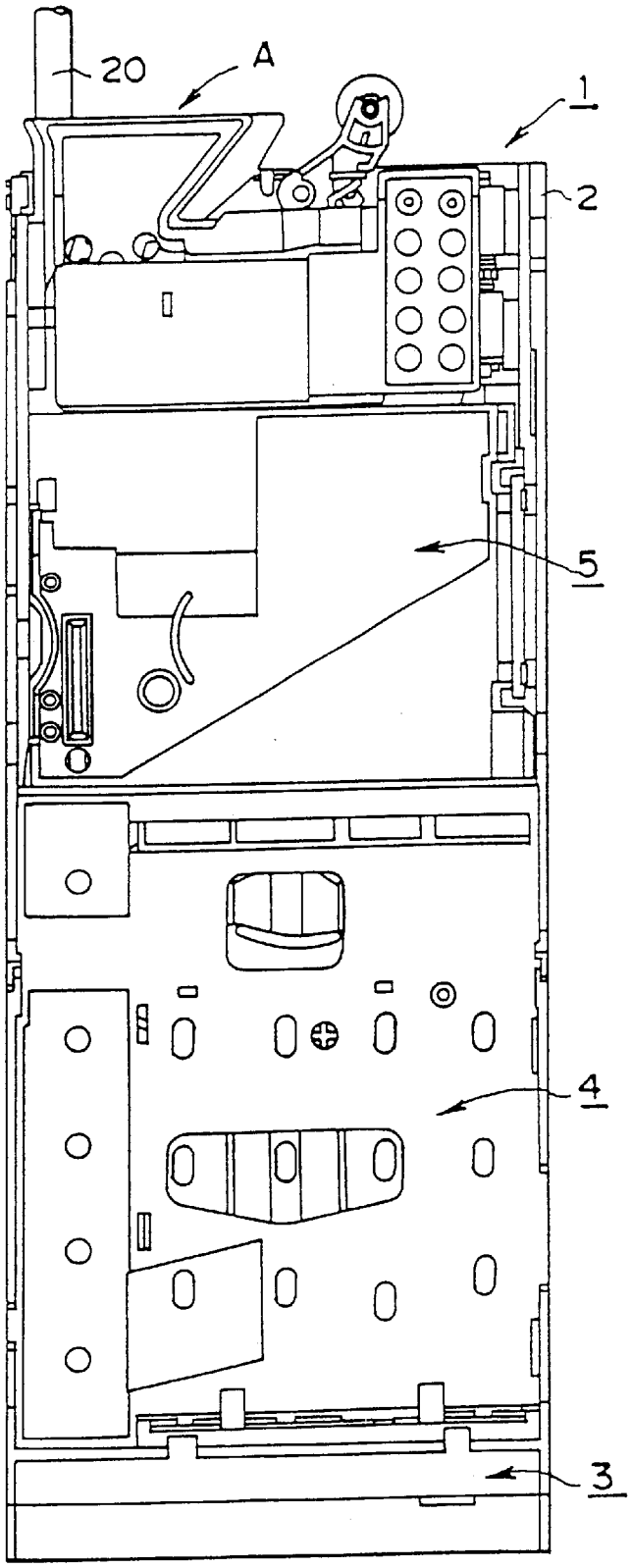
FIG. 1 is a front view of the first embodiment of the coin handling device to which the first invention pertains.

FIG. 1 is a front view of the coin handling device 1 to which the first invention pertains.

The coin handling device 1 comprises the following three sections as in conventional devices.

The first section is the device body 2, which constitutes the casing of the coin handling device 1. At the very bottom of the device body 2 is located a coin dispenser unit 3 which serves to dispense change.

The second section is a coin storage unit 4, located directly above the coin dispenser unit 3 and storing coins which have been sorted by denomination. As in the case of conventional devices, the coin storage unit 4 comprises a plurality of coin tubes, and is fitted to the device body 2 in such a manner as to be capable of being attached and detached freely.

The third section is a coin sorting unit 5, which is located directly above the coin storage unit 4 and serves to identify coins inserted through the coin insertion aperture A as authentic or counterfeit, and to identify the denominations of authentic coins. As in the case of conventional devices, the coin sorting unit 5 is fitted to the device body 2 in such a manner as to be capable of being attached and detached freely.

Figure 2:
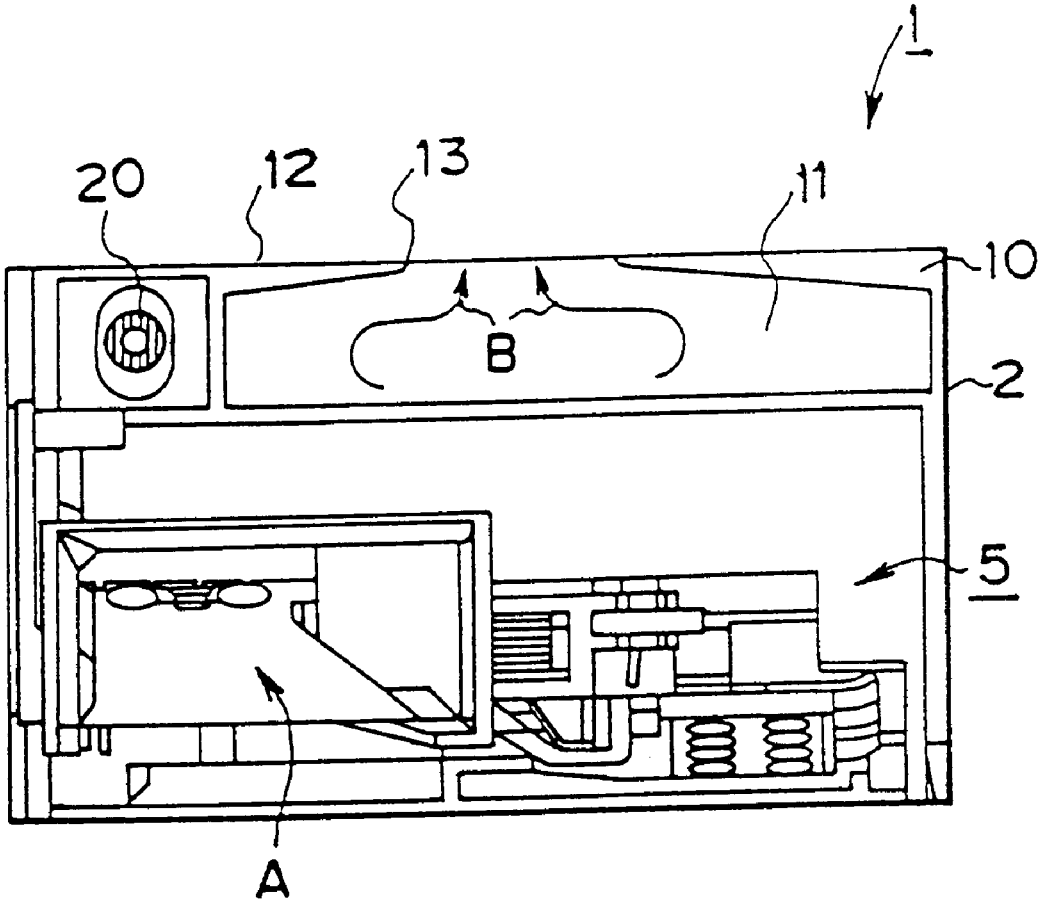
FIG. 2 is a top view of the coin handling device to which the first invention pertains.

Meanwhile, as may be seen from the top view of the device body 2 in FIG. 2, a concave section 11 is formed along its perimeter. The bottom surface of the concave section 11 is formed so as to incline towards the rear surface 12 of the device body 2, while in the centre of the rear surface 12 is formed a cutting 13 which connects to the interior of the concave section 11.

The upper surface 10 of the device body 2 allows liquid which drops on to it to be guided thanks to the concave section 11 on to the rear surface 12 of the device body 2, as is denoted by the arrows B. It then drops through the cutting 13 to below the rear surface 12.

Figure 3:
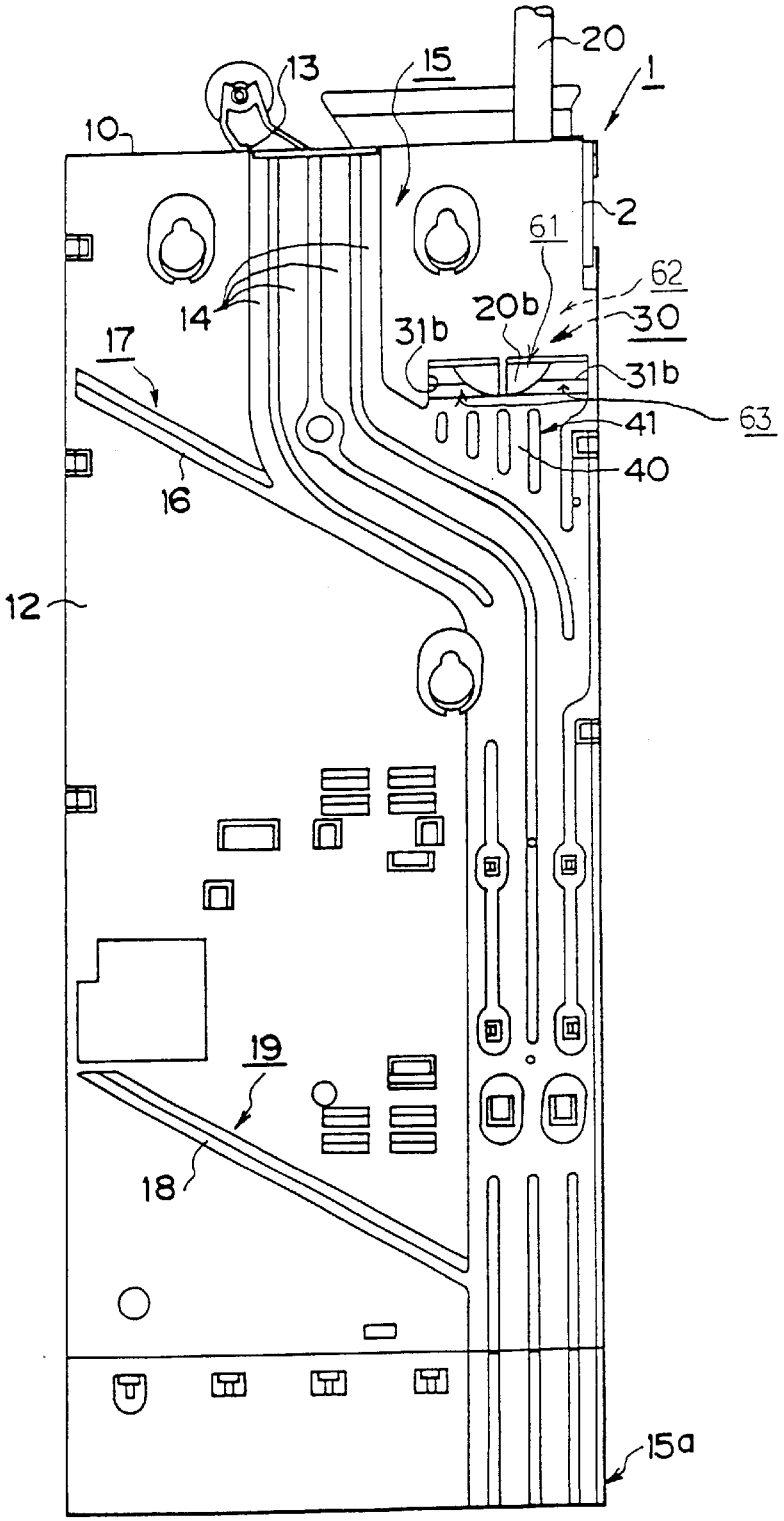
FIG. 3 is a rear view of the coin handling device to which the first invention pertains.

Meanwhile, as may be seen from the rear view of the device body 2 in FIG. 3, there is formed on the rear surface 12 of the device body 2 a liquid guide groove 15 comprising a plurality of concave sections 14.

The upstream end of the liquid guide groove 15 faces on to the cutting 13, while the groove itself is formed in such a manner that it bends to the right partway along its length, its downstream end 15*a* then extending downwards along the right-hand edge of the device body 2.

Partway along its length, the liquid guide groove 15 is joined by a liquid guide groove 17 comprising a plurality of concave sections 16 formed above on the rear surface 12 of the device body 2 crossing toward the right part, and by a further liquid guide groove 19 comprising a plurality of concave sections 18 formed below on the rear surface 12.

By means of the liquid guide grooves 15, 17, 19 comprising the concave sections 14, 16, 18, of any liquid dropping on to the upper surface 10 of the device body 2, liquid which drops within the concave section 11 illustrated in FIG. 2 is guided by the liquid guide groove 15 illustrated in FIG. 3 to the righthand side of the rear surface 12 of the device body 2, whence it drops down further and is discharged swiftly to outside the device body 2.

Meanwhile, liquid which has overflowed from the upper surface 10 of the device body 2 illustrated in FIG. 2 is collected by the liquid guide grooves 17, 19 illustrated in FIG. 3 crossing towards the right partway down the rear surface 12 of the device body 2, whence it drops down further and is discharged swiftly to outside the device body 2.

Within the device body 2 is located a cable 20 which serves to feed electric power and signals to the various pieces of electronic apparatus installed within it.

As FIG. 2 demonstrates, the cable 20 extends from the left-hand side of the upper surface 10 of the device body 2 towards the interior thereof.

Consequently, there is a risk that any liquid dropping on the cable 20 may run down the cable 20 and penetrate the interior of the device body 2.

On the other hand, as FIG. 3 shows, a liquid storage box 30 is formed at the top within the device body 2, and this serves temporarily to store any liquid which runs down the cable 20.

Figure 4:
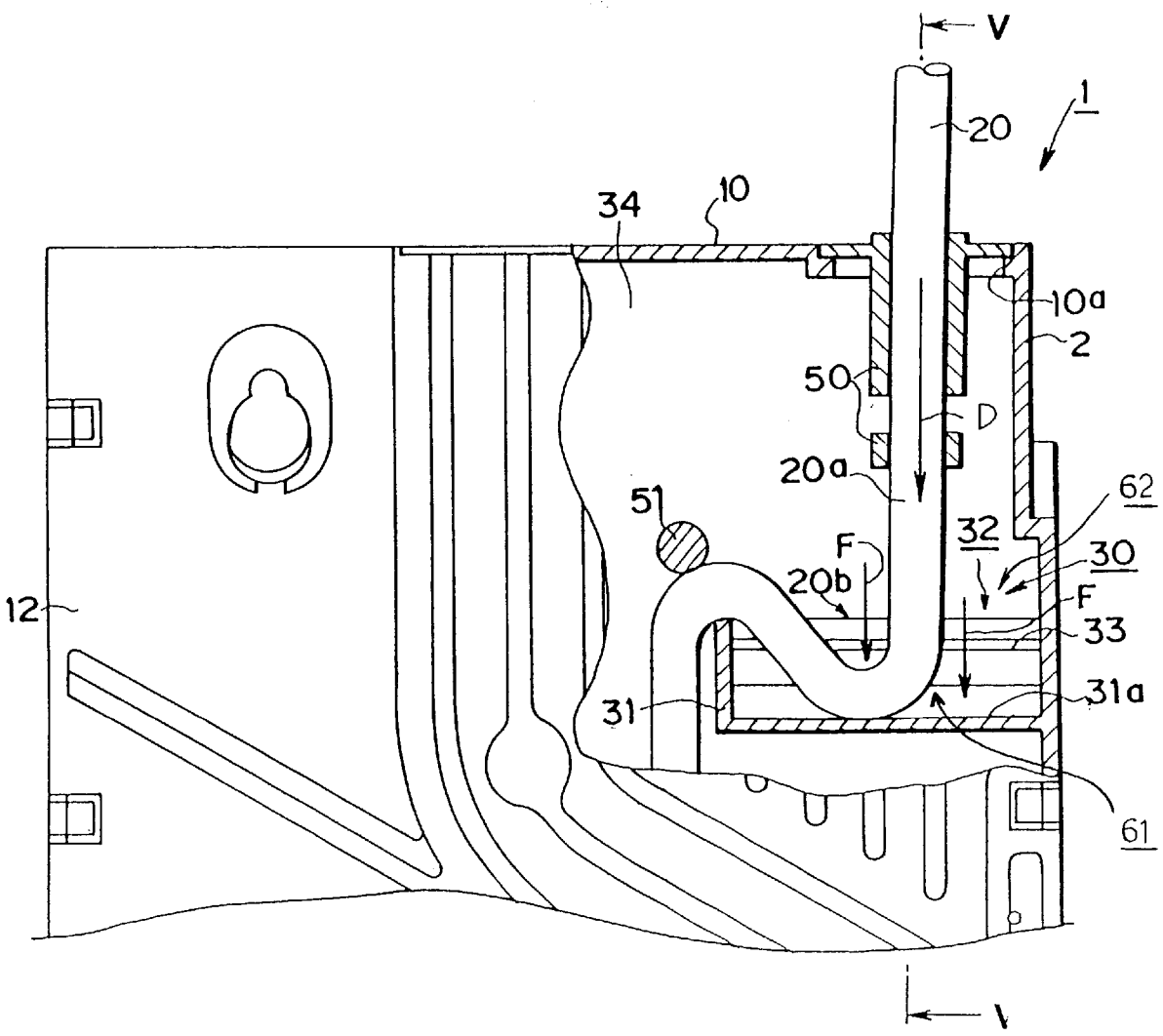
FIG. 4 is an enlarged cut-away view of the principal part of FIG. 3.

As may be seen from FIG. 4, which is an enlarged cut-away view of the principal part of FIG. 3, the liquid storage box 30 comprises a body 31 of the box 30 and a lid 32 which covers the upper surface thereof, the box body 31 being integral with the device body 2 and having a cross-section shaped roughly in the form of three sides of a rectangle.

A slit 33 is formed in the centre of the lid 32, and into the slit 33 is inserted a cable bend 20*b* formed by bending the upper end 20*a* of the cable 20 roughly in the shape of a letter U.

Figure 5:
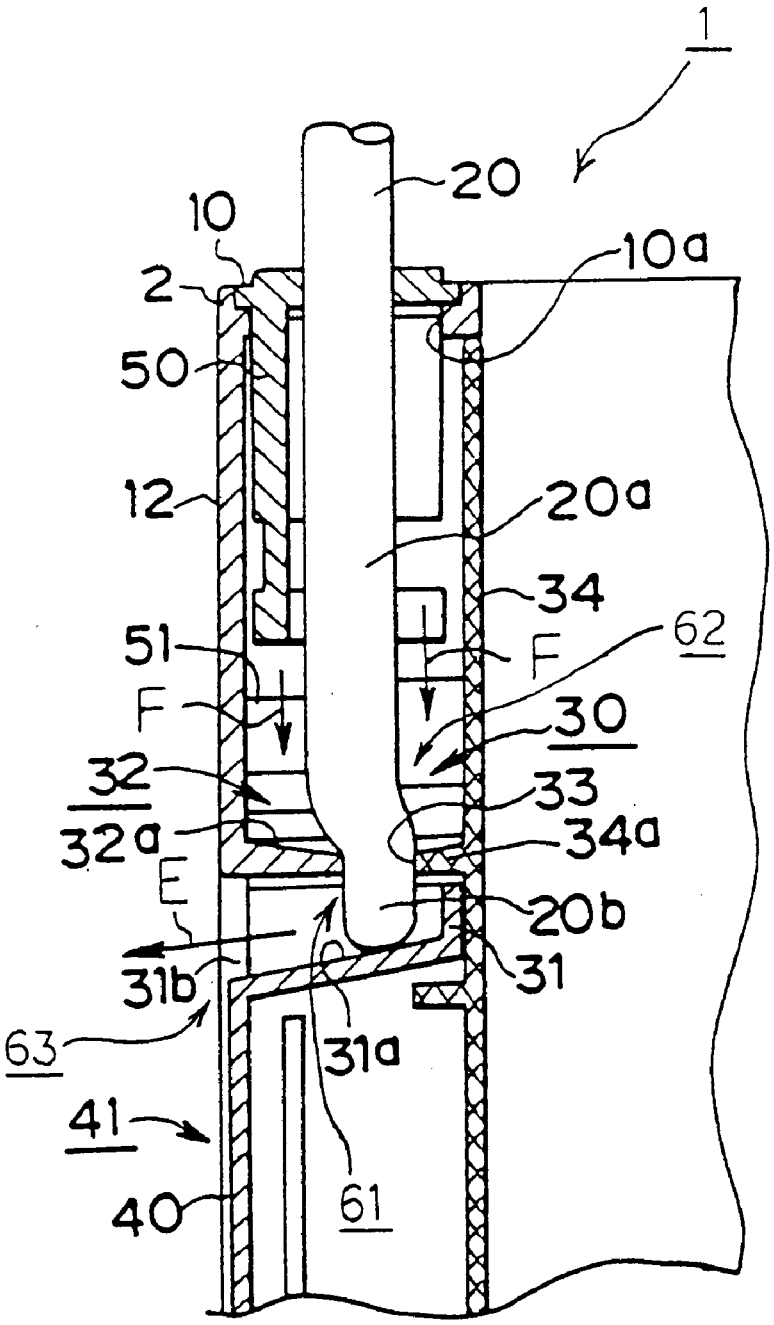
FIG. 5 is a schematic cross-section along the line V—V in FIG. 4.

As may be seen from FIG. 5, which is a schematic cross-section along the line V—V in FIG. 4, the lid 32 comprises one lid section 32*a* being integral with the device body 2 in such a manner as to create in its centre the slit 33 into which the cable bend 20*b* is inserted, and another lid section 34*a* being integral with a centre cover 34 which covers the interior of the device body 2. The upper surfaces of the lid sections 32*a*, 34*a* are formed in such a manner as to incline towards the slit 33.

A bottom surface 31*a* of the box body 31 is inclined toward the rear surface 1 of the device body 2, and at the end the bottom surface 31*a* are formed two liquid discharge outlets 31*b* (FIG. 3).

The cable bend 20*b*, which is formed roughly in the shape of a letter U at the upper end 20*a* of the cable 20, and the lid 32, which covers the upper surface of the box body 31 and is formed in such a manner as to incline towards the slit 33 into which the cable bend 20*b* is inserted, constitute liquid guide means 61, which serves to guide liquid dropping down along the cable and through the cable guide hole 10*a* into the device body 2.

Meanwhile, the liquid storage box 30, which consists of the box body 31 having a cross-section shaped roughly in the form of three sides of a rectangle, forms liquid storing means 62, which serves to store the aforesaid liquid guided by virtue of the liquid guide means 61. At the same time, a liquid discharge outlet 31*b* formed in the box body 31 constitutes liquid discharging means 63, which serves to discharge liquid stored in the liquid storing means 62 to outside the body of the device.

As FIG. 3 shows, there is formed on the rear surface 12 of the device body 2 beneath the liquid discharge outlet 31*b* a liquid guide groove 41 comprising a plurality of concave sections 40. The end of the liquid guide groove 41 connects with the aforesaid liquid guide groove 15.

In FIGS. 4 and 5, the reference number 50 is a cable guide which not only covers the cable guide hole 10*a* formed on the upper surface 10 of the device body 2, but also holds the upper end 20*a* of the cable 20, and the reference numeral 51 is a guide rod which regulates the attitude of the cable 20.

There follows a description concerning the action of the liquid storage box 30.

As FIG. 4 demonstrates, liquid dropping down along the cable 20 (arrow D) enters by way of the slit 33 into the body 31 of the liquid storage box 30, where it is temporarily stored. Then, as arrow E in FIG. 5 shows, the liquid which has been stored temporarily in the liquid storage box body 31 is guided thanks to the inclined bottom surface 31*a* of the box body 31 to the liquid discharge aperture 31*b*. Then, as may be seen from FIG. 3, liquid which has been discharged through the liquid discharge aperture 31*b* is guided to the liquid guide groove 41 comprising a plurality of concave sections, and in this manner discharged swiftly from inside the device body 2.

Meanwhile, as FIG. 5 shows, liquid dropping down from the vicinity of the cable guide hole 10*a* (arrow F) is caught by the lid 32 having the respectively inclined lid sections 32*a*, 34*b*. The liquid which has been caught by the lid 32 drops down by way of the slit 33 into the body 31 of the liquid storage box 30 (FIG. 4), where it is temporarily stored. Then, the liquid which has been stored in the box body 31 is discharged swiftly from inside the device body 2 by the same route as above.

Consequently, the liquid storage box 30 allows liquid which drops along the cable 20 and through the cable guide hole 10*a* to drop down further with the aid of the slit 33 and the lid 32 inclined towards the slit 33 into the body 31 of the liquid storage box 30, where it is stored. The liquid which has been stored in the box body 31 in this manner is discharged swiftly from inside the device body 2 by way of the liquid discharge aperture 31*b*.

Thus, the first embodiment is a coin handling device 1 having at least a cable 20 which serves to feed various signals and electric power, a cable guide hole 10*a* which is formed on the upper surface 10 of the device body 2 and into which the cable 20 is inserted, and a coin-sorting unit 5 located within the device body 2 which serves to sort inserted coins into authentic ones and counterfeit ones. In this embodiment, the cable bend 20*b* formed at the upper end 20*b* of the cable 20 is located within the liquid storage box 30 formed within the device body 2 and having a slit 33 towards which the lid 32 of the liquid storage box 30 is inclined, in such a manner that liquid dropping along the cable 20 and through the cable guide hole 10*a* is guided with the aid of the slit 33 and the lid 32 into the body of device 2, where it is stored in the liquid storage box 30, after which it is discharged swiftly to the rear surface 12 of the device body 2 by way of the liquid discharge aperture 31*b* formed on the side of the liquid storage box 30. In this manner it is possible to prevent, as far as is feasible, liquid dropping down along the cable 20 and through the cable guide hole 10*a* from adhering to the various components within the device body 2, thus providing a coin handling device which will function in a stable fashion over long periods of time, and to guard the coin handling device against pranks involving the pouring of liquid into it.

In other words, the coin handling device to which the first invention pertains has at least a cable 20 which serves to feed various signals and electric power, a cable guide hole 10*a* which is formed on the upper surface 10 of the device body 2 and into which the cable 20 is inserted, and a coin-sorting unit 5 located within the device body 2 which serves to sort inserted coins into authentic ones and counterfeit ones. This coin handling device has liquid guide means which serves to guide liquid dropping down along the cable 20 and through the cable guide hole 10*a* into the device body 2, liquid storing means 62 which serves to store the aforesaid liquid guided by virtue of the liquid guide means 61, and liquid discharging means 63 which serves to discharge liquid stored in the liquid storing means 62 to outside the body of the device. In this manner, liquid dropping down along the cable 20 and through the cable guide hole 10*a* is guided by the liquid guide means 61 into the device body 2, where it is stored with the aid of the liquid storing means 62, and is then discharged with the aid of the liquid discharging means 63 to outside the device body 2, thus making it possible, as far as is feasible, to prevent liquid dropping down along the cable 20 and through the cable guide hole 10*a* from adhering to the various components within the device body 2.

Consequently, the coin handling device to which the first invention pertains is capable of functioning in a stable fashion over long periods of time, and can be guarded effectively against pranks involving the pouring of liquid into it.

There follows next a detailed description of the first and second embodiments of the coin handling device to which the second invention pertains.

Figure 6:
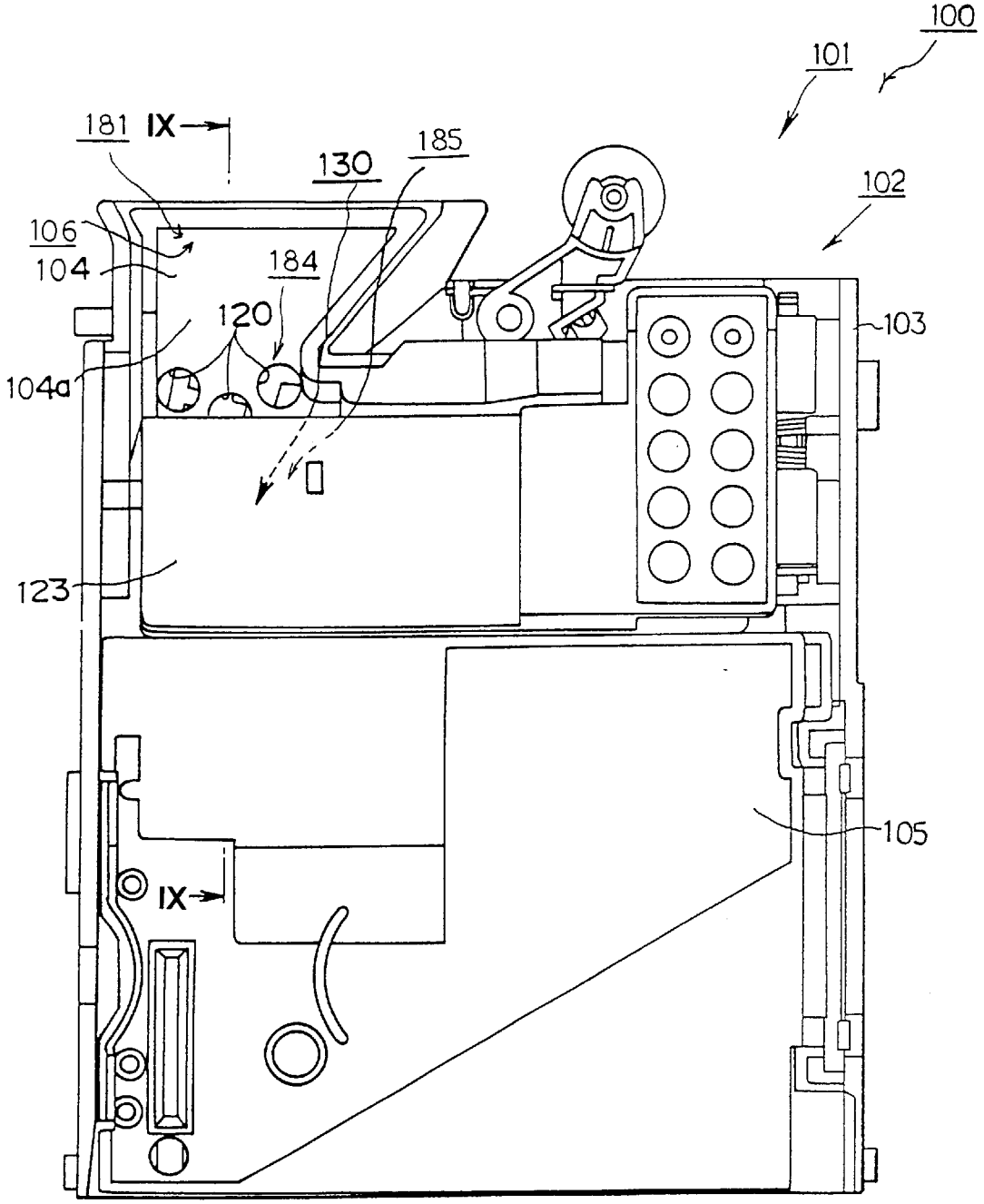
FIG. 6 is a front view of the first embodiment of the coin handling device which the second invention pertains, illustrating the coin-sorting unit.

FIG. 6 is a front view of the first embodiment of the coin handling device to which the second invention pertains, illustrating the coin-sorting unit.

The first embodiment of the coin handling device 100 to which the second invention pertains has a coin sorting unit 101 with an identification unit 102 comprising a main plate 103 formed of a hard high-molecular material. The upper part of the main plate 103 is covered with a gate plate 104, also formed of a hard high-molecular material, in such a manner as to be capable of being opened and closed freely.

The lower part of the front of the main plate 103 is similarly covered with a front cover 105 in such a manner as to be capable of being opened and closed freely. Between the main plate 103 and the front cover 105 is formed a plurality of coin passages.

Figure 7:
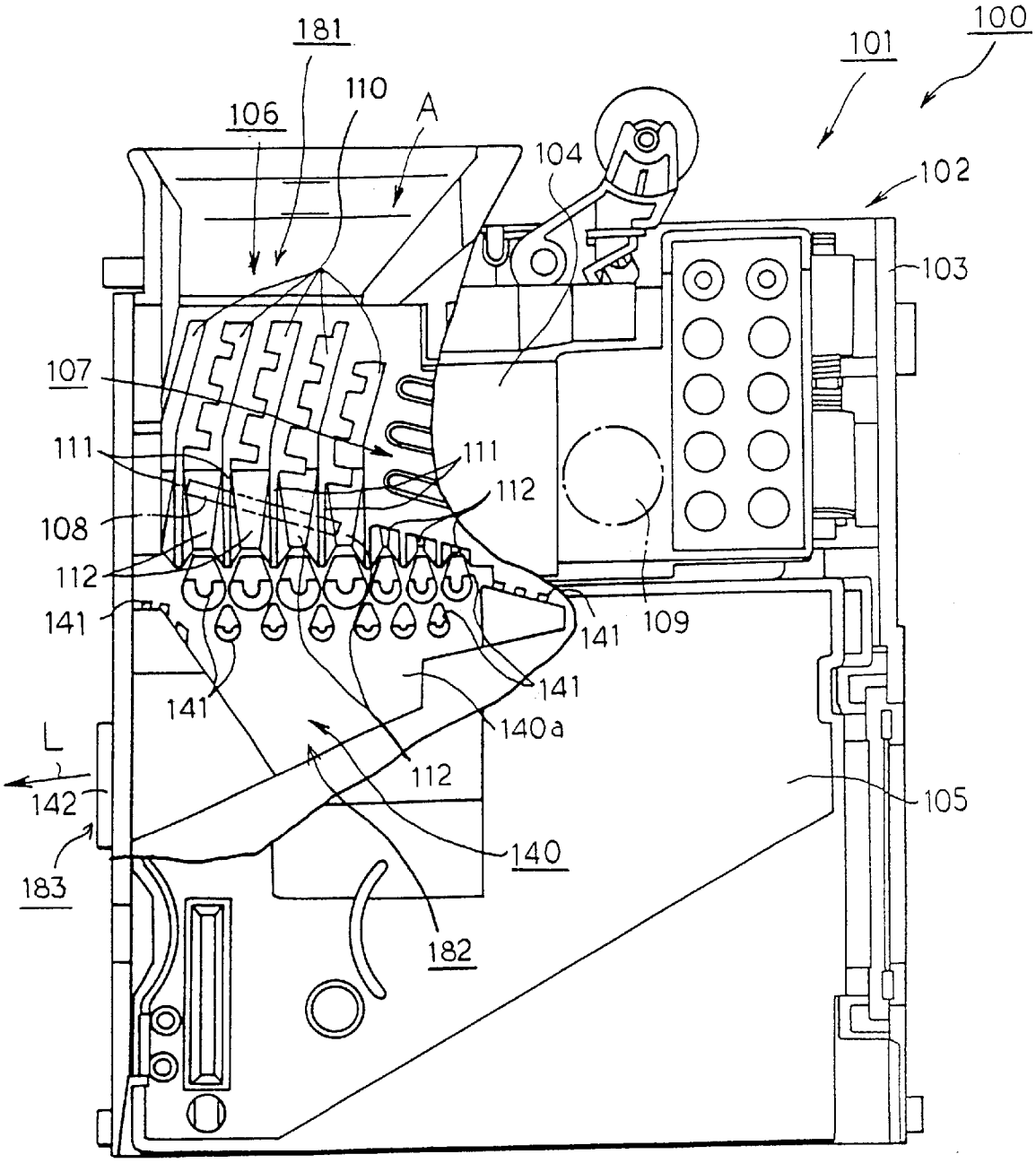
FIG. 7 is an enlarged cut-away view of the principal part of FIG. 6.

As may be seen from FIG. 7, which is a front view of the coin sorting unit 101 with part of the gate plate 104 and front cover 105 cut away, a coin insertion aperture A is formed between the upper section of the main plate 103 and the gate plate 104. More or less vertically beneath the coin insertion aperture A is formed a coin passage 106, which is connected directly to the coin insertion aperture A and serves to guide coins inserted through the coin insertion aperture A more or less vertically downwards. The coin passage 106 formed by the main plate 103 and the gate plate 104 constitutes coin guide means 181, which serves to guide coins inserted through the coin insertion aperture A more or less vertically downwards.

At the downstream end of the coin passage 106 is formed an inclined coin passage 107 which causes coins dropping vertically down the coin passage 106 to roll to the right of the drawing. The coin passage 107 comprises a metal gate rail 108 located on the gate plate 104, and partway down it is located a coin sensor 109 which identifies inserted coins as authentic or counterfeit, and determines the denomination of the authentic coins.

Beneath the end of the coin passage 107 between the main plate 103 and front cover 105 are formed coin sorting means, which comprises a solenoid or similar device (not illustrated in the drawing) for sorting inserted coins by denomination in accordance with detection signals from the coin sensor 109, and separate coin passages which guide the coins after sorting according to denomination.

In this manner, the main plate 103 and the gate plate 104 constitute the coin passage 106, which connects directly to the coin insertion aperture A and is formed facing more or less vertically downwards. On the main plate 103 side is formed a plurality of liquid guide concave sections 110 which serve to block liquid introduced through the coin insertion aperture A and guide it downstream, and liquid guide walls 111 which form extensions to the liquid guide concave sections 110 downstream. It should be added that this plurality of liquid guide concave sections 110 is inclined towards the upstream side of the coin passage 107, and is formed in this manner so that liquid introduced through the coin insertion aperture A will not head downstream along the coin passage 107.

These liquid guide walls 111 are formed facing vertically downwards, and the downstream end thereof faces the liquid inlet hole of the liquid collection unit described below. Between the liquid guide walls 111 are formed liquid guide channels 112.

Figure 8:
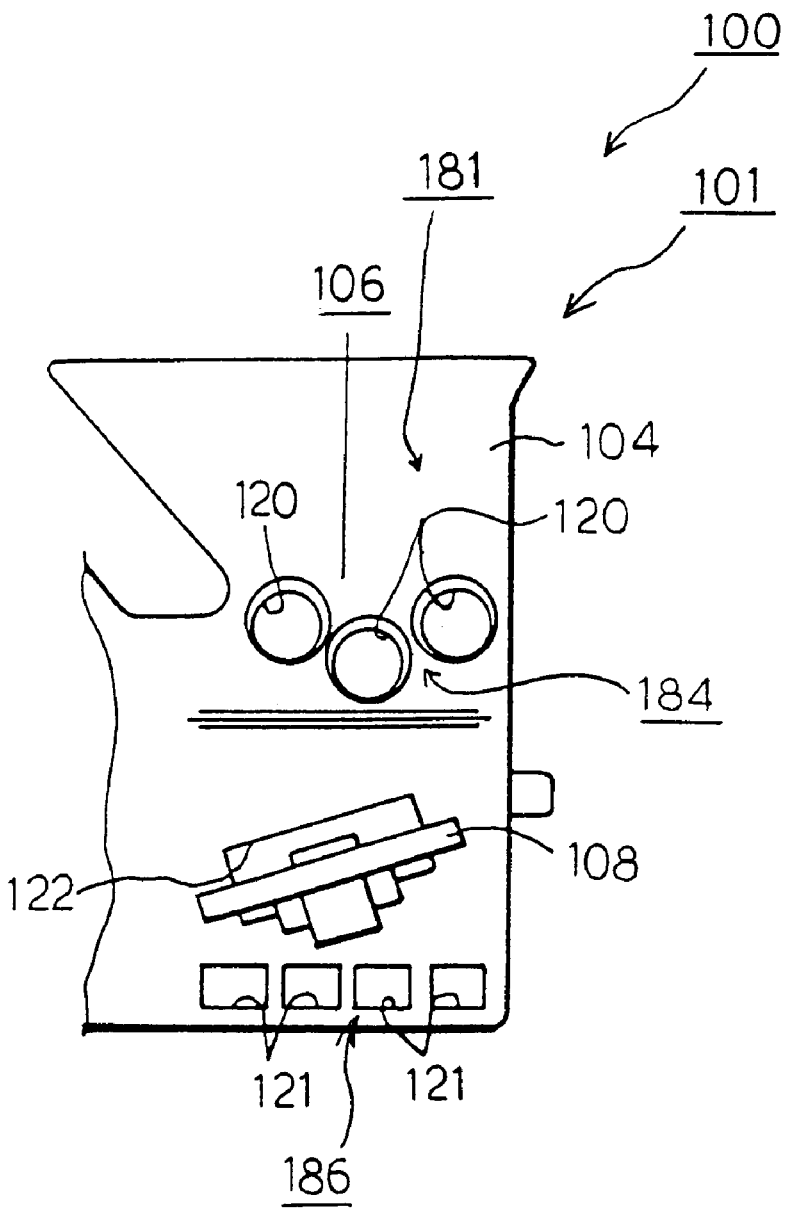
FIG. 8 is an enlarged cut-away view of the gate plate.

Meanwhile, no liquid guide grooves are formed on the gate plate 104 which constitutes the other side of the coin passage 106. As may be seen from FIG. 8, which is an enlarged cut-away view of the principal part of the gate plate, liquid inlet holes 120 having a circular cross-section are formed facing in a lateral direction in three places on the upstream side of the coin passage 106.

On the downstream side of the coin passage 106 is formed a plurality of liquid outlet holes 121 having a rectangular cross-section and facing towards the liquid collection unit described below. In the first embodiment, these liquid outlet holes 121 are formed in four places and face in a lateral direction.

The liquid inlet holes 120 constitute liquid flow-in means 184, which allows liquid dropping down the coin guide means 181 to flow into the coinsorting unit 101 rather than into the liquid collecting means described below. The liquid outlet holes 121 constitute liquid flow-out means 186, which allows liquid which has been allowed to pass the liquid passing means, also described below, to flow out to the liquid discharging means described below.

It should be added that the aforesaid metal gate rail 108 is fitted by virtue of snap action to the gate plate 104 midstream in the coin passage 106, in such a manner as to be capable of being attached and detached freely within the gate rail insertion hole 122.

As FIG. 6 demonstrates, a sub-plate 123 having a cross-section shaped roughly in the form of three sides of a rectangle is fitted to the lower section of the rear surface 104*a* of the gate plate 104 in such a manner as to be capable of being attached and detached freely. Between the sub-plate 123 and the lower section of the rear surface 104*a* of the gate plate is formed a liquid flow passage 130 through which are allowed to pass large amounts of liquid. The liquid flow passage 130 constitutes the liquid passing means 185, which allows large amounts of liquid to pass, having been allowed to flow in by the liquid flow-in means 184.

As may be seen from FIG. 7, a box-shaped liquid collection unit 140 which collects liquid dropping down along the coin passage 106 is formed on the main plate 103 below the gate rail 108 and integrally with the main plate 103. The liquid collection unit 140 constitutes liquid collecting means 182, which serves to collect liquid dropping down the coin guide means 181.

On the upper surface 140*a* of the liquid collection unit 140 is formed a plurality of liquid inlet holes 141 of various sizes, while a liquid discharge passage 142 is formed on the lower left-hand side in order to discharge liquid which has collected. The liquid discharge passage 142 constitutes liquid discharging means 183, which serves to discharge collected liquid to outside the device.

Figure 9:
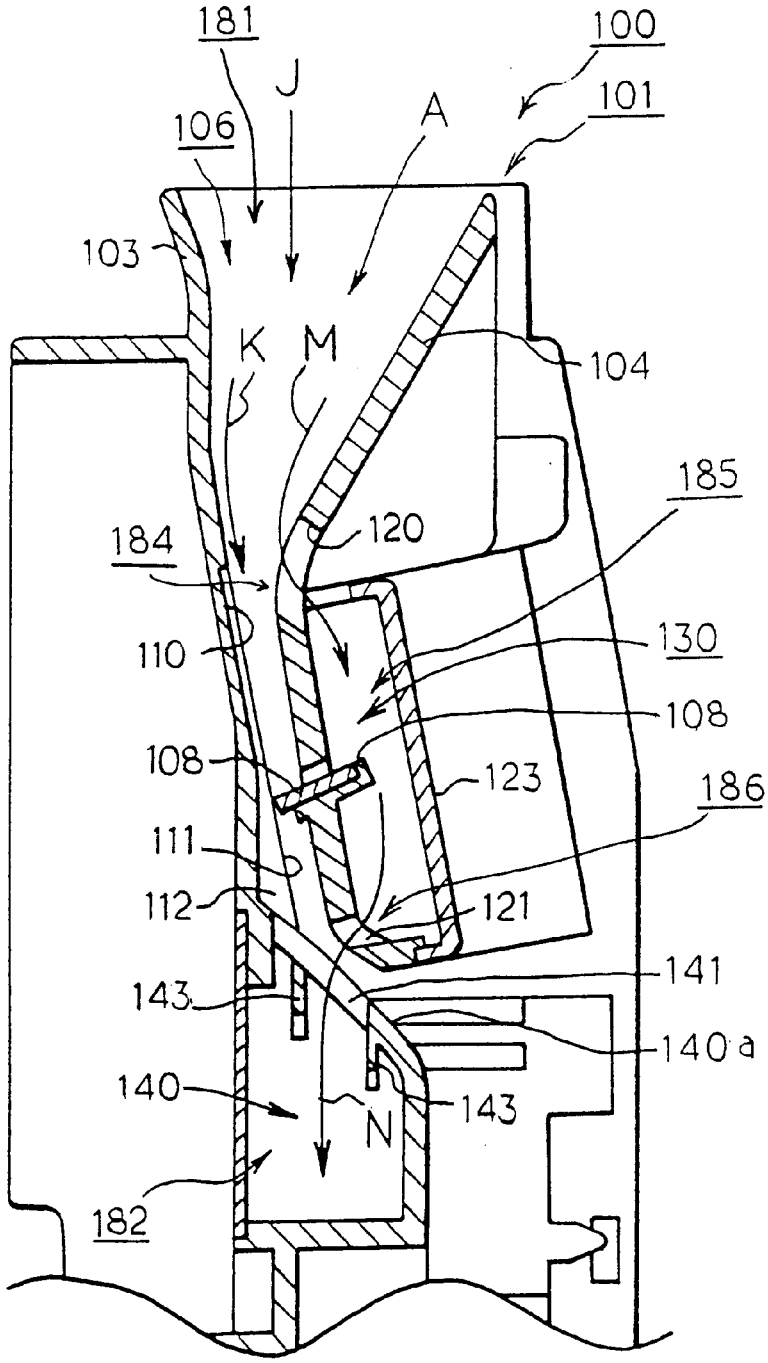
FIG. 9 is an enlarged cross-section along the line IX—IX in FIG. 6.

As may be seen from FIG. 9, which is a schematic enlarged cross-section along the line IX—IX in FIG. 6, a fin 143 is formed integrally facing vertically downwards so as to allow dropping liquid to drop smoothly into the liquid collection unit 140.

There follows an explanation of the action of discharging liquid in the coin sorting unit 101 of the coin handling device 100 to which the first embodiment of the second invention pertains.

As FIG. 9 shows, if detergent or a similar liquid J is introduced through the coin insertion aperture A, some of the liquid drops into the liquid collection unit 140 by way of the plurality of liquid guide concave sections 110 formed on the main plate 103, the liquid guide channels 112 formed between the liquid guide walls 111, and the plurality of liquid inlet holes 141 of the liquid collection unit 140. This is then swiftly discharged to outside the device 100 by way of the passage 142 illustrated in FIG. 7, as shown by the arrow L.

Meanwhile, as may be seen from FIG. 9, some of the liquid J introduced through the coin insertion aperture A is guided as liquid M downstream along the gate plate 104. The liquid M enters through the liquid inlet holes 120 having a circular cross-section which are formed in the gate plate 104, and pass the liquid flow passage 130 which is formed between the sub-plate 123 and the gate plate 104, and through which large amounts of liquid are allowed to pass. After that it drops down into the liquid collection unit 140 by way of the liquid outlet holes 121 which are formed facing the upper surface 140*a* of the liquid collection unit 140, as shown by the arrow N. It is then discharged to outside the device 100 by way of the liquid discharge passage 142 illustrated in FIG. 7, as shown by the arrow L.

Thus, as FIG. 9 demonstrates, in the coin handling device 100 to which the abovementioned first embodiment pertains, some of the liquid J introduced through the coin insertion aperture A is guided downstream along the gate plate 104, dropping down into the liquid collection unit 140 by way of the liquid flow passage 130, through which large amounts of liquid are allowed to pass, and the liquid outlet holes 121. As a result, even if the liquid J is poured into the coin insertion aperture A in large amounts, it is swiftly discharged through the liquid discharge passage 142, so that the risk of it overflowing from the coin passage 106 is reduced as far as is feasible.

In other words, the coin handling device 100 to which the first embodiment of the second invention pertains has a coin-sorting unit 101, coin guide means 181 which serves to guide coins inserted by way of the coin insertion aperture A downwards roughly vertically, liquid collecting means 182 which serves to collect liquid dropping down the coin guide means 181, and liquid discharging means 183 which serves to discharge the collected liquid to outside the device, being further equipped with liquid flow-in means 184, which allows liquid dropping down the coin guide means 181 to flow into the coin-sorting unit 101 rather than into the liquid collecting means 182, liquid passing means 185, which allows large amounts of the liquid which has been allowed to flow in to pass, and liquid flow-out means 186, which allows the liquid which has been allowed to pass to flow out to the liquid discharging means. As a result, even supposing detergent or a similar viscous liquid is poured into the coin insertion aperture A in large amounts, it is swiftly discharged to outside the device by way of the liquid flow passage 130 formed on the rear surface of the gate plate 104 and the liquid collection unit 140, making it possible to prevent, as far as is feasible, the liquid from overflowing from the coin passage 106.

Moreover, in the coin handling device 100 to which the first embodiment pertains, no liquid guide groove is formed on the gate plate 104, one of the plates constituting the coin passage 106, which is the coin guide means 181. Thus, it can be ensured that when the main plate 103 and the gate plate 104 are opened in order to return coins which have lodged between them, it is possible to do so and return the coins without any of them becoming wedged between the main plate 103 and the gate plate 104, thus providing a coin handling device having a stable function for the return of lodged coins.

Furthermore, in the coin handling device 100 to which the first embodiment pertains, liquid running down the liquid flow passage 130 of the gate plate 104 is guided temporarily into the liquid collection unit 140, and then discharged from there by way of the liquid discharge passage 142. However, this invention is in no manner restricted to the above embodiment, and it is also possible for liquid to be discharged by guiding it directly to a liquid collection passage 142 formed on the main plate 103.

Figure 10:
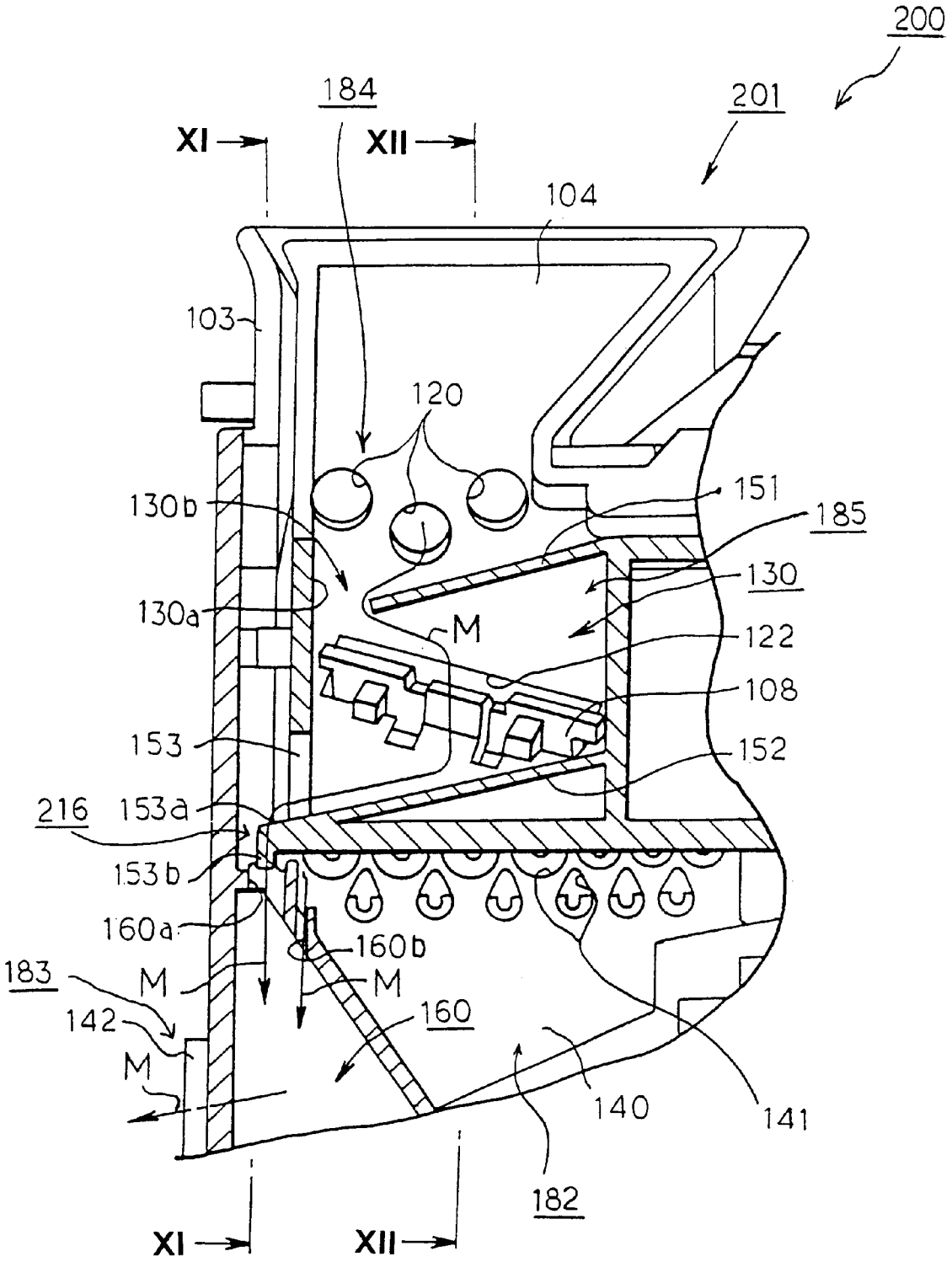
FIG. 10 is an enlarged cross-section of the second embodiment of the coin handling device to which the second invention pertains, illustrating the coin-sorting unit.

FIG. 10 is an enlarged cross-section of the second embodiment of the coin handling device to which the second invention pertains, illustrating the coin-sorting unit. In particular, it is shown with the sub-plate 123, which forms the liquid flow passage 130, removed. Components which are the same as those illustrated in FIGS. 6–9 have been allocated the same reference numbers or symbols.

In the coin handling device 200 to which the second embodiment of the second invention pertains, two liquid guide ribs 151, 152 are formed above and below the gate plate 104 within the liquid flow passage 130, integrally with it and inclining from right to left in the drawing. Of these, the upper liquid guide rib 151 does not reach as far as the left-hand side 130*a* of the liquid flow passage 130, where a hole 130*b* is formed.

On the left-hand side 130*a* of the liquid flow passage 130 is also formed a liquid outlet hole 153, which causes liquid running along the liquid flow passage 130 to drop down towards the liquid discharge passage 142. The bottom surface 153*a* of the liquid outlet hole 153 extends a prescribed distance to the left of the drawing, and on its under surface there protrudes towards the liquid discharge passage 142 a liquid guide protrusion 153*b* having a elliptical cross-section.

Figure 11:
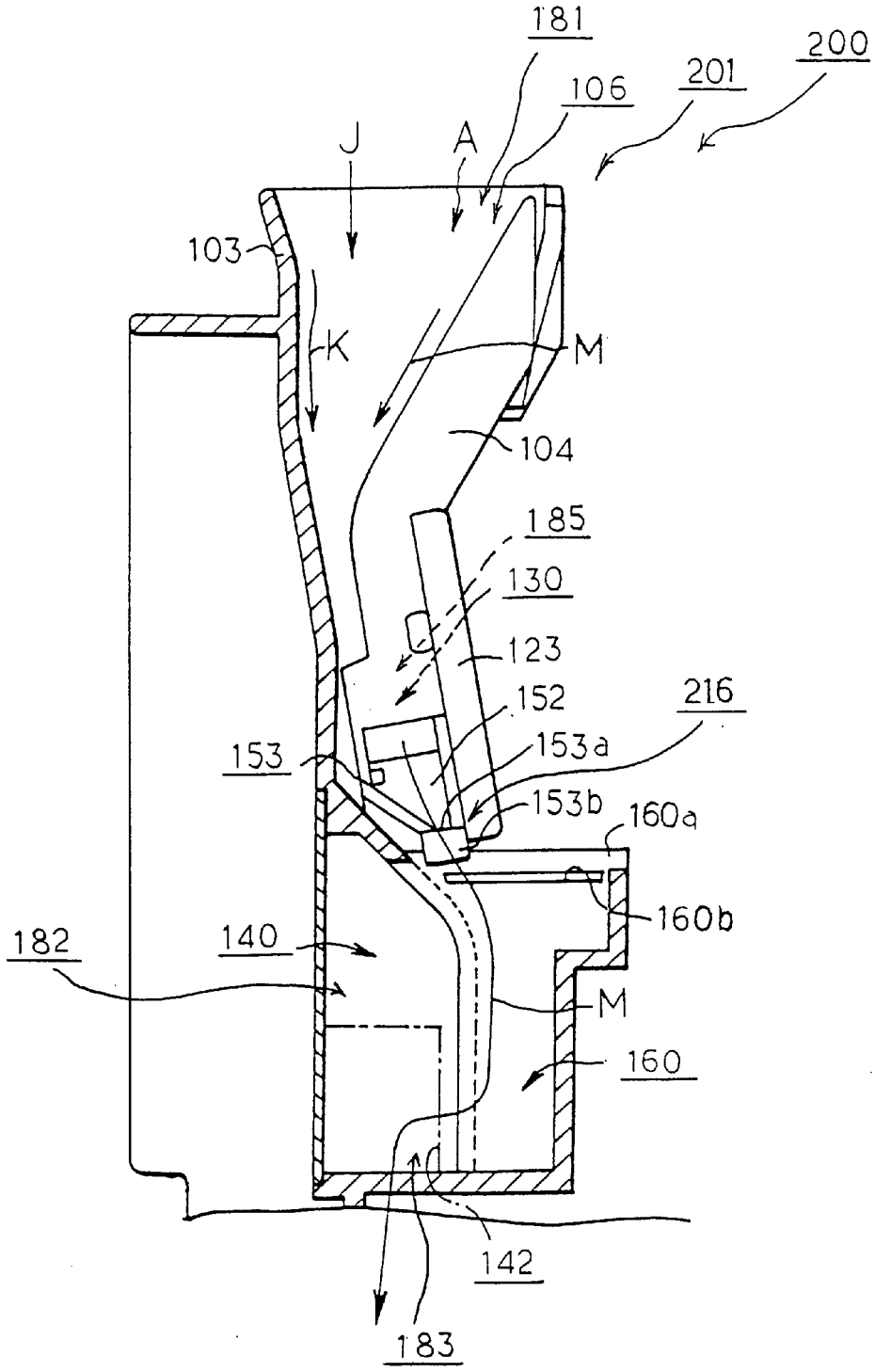
FIG. 11 is a schematic cross-section along the line XI—XI in FIG. 10.

As may be seen from FIG. 11, which is a schematic cross-section along the line XI—XI in FIG. 10, there is formed on the right-hand side of the liquid discharge passage 142 within the coin sorting unit 201 of the coin handling device 200 to which this second embodiment pertains a liquid storage concave section 160 which connects with the liquid discharge passage 142 and the liquid collection unit 140. At the top of this is formed an aperture 160*a*, on to which the aforesaid liquid guide protrusion 153*b* abuts.

The liquid outlet hole 153 and liquid guide protrusion 153*b* replace the liquid flow-out means 186 of the coin handling device 100 to which the first embodiment pertains, and constitute a liquid flow-out means 216, allowing liquid which has passed through the liquid passing means 185 to flow out to the liquid discharging means 183. The liquid flow passage 130 constitutes the liquid passing means 185, which allows large amounts of liquid to pass from the liquid inlet hole 120 towards the liquid outlet hole 153 and liquid guide protrusion 153*b*.

As FIGS. 10 and 11 show, a slit 160*b* is formed on the rear surface of the aperture 160*a* of the liquid storage concave section 160.

Figure 12:
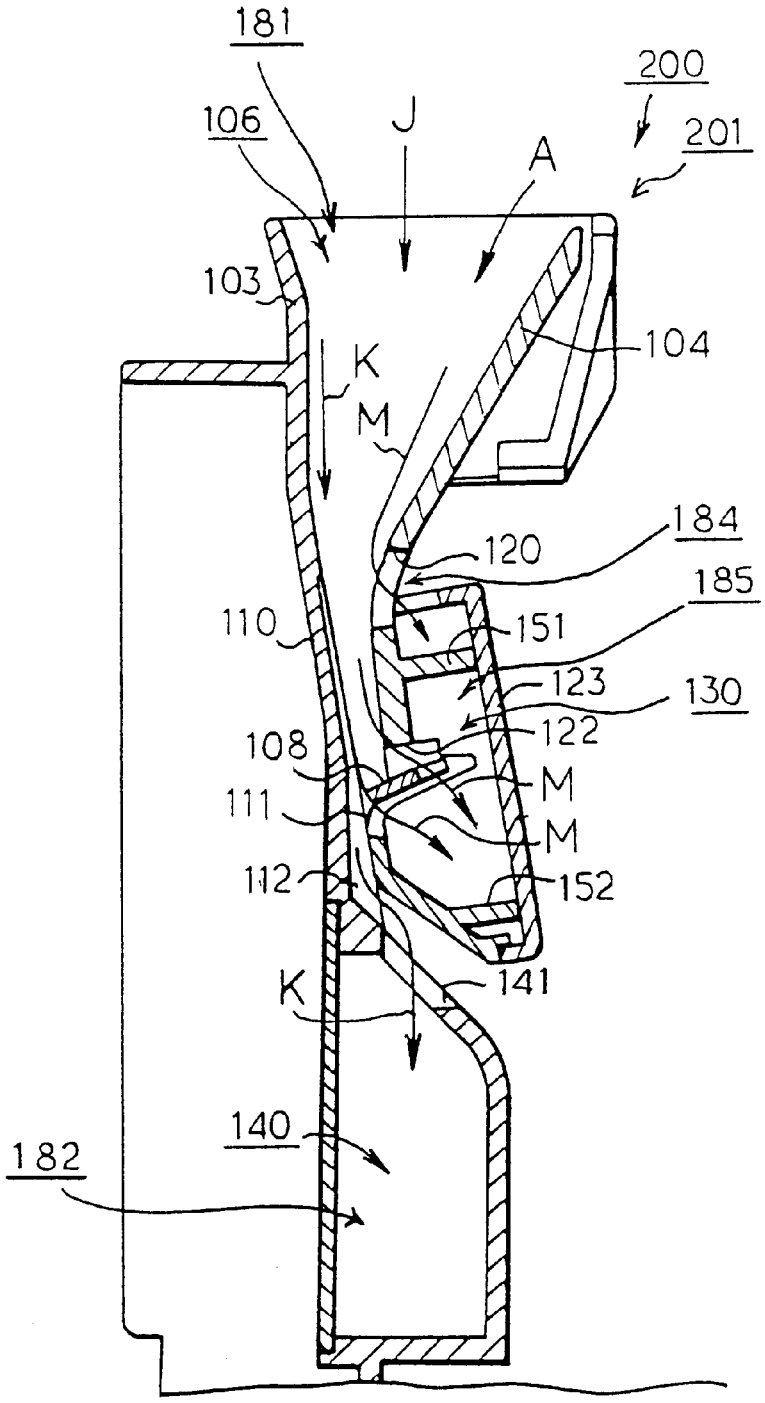
FIG. 12 is a schematic cross-section along the line XII—XII in FIG. 10.

In the coin handling device 200 to which the second embodiment pertains, liquid flowing on the main plate 3 side in the coin sorting unit 201 drops down into the liquid collection unit 140 by way of the plurality of liquid guide concave sections 110, the liquid guide channels 112 formed between the liquid guide walls 111, and the plurality of liquid inlet holes 141 of the liquid collection unit 140, as is demonstrated by the arrow K in FIG. 12, which is a schematic cross-section along the line XII—XII in FIG. 10. This is then swiftly discharged by way of the liquid discharge passage 142 illustrated in FIG. 10.

Meanwhile, in the coin sorting unit 201 of the coin handling device 200 to which the second embodiment pertains, as may be seen from FIG. 12, some of the liquid J introduced through the coin insertion aperture A is guided as liquid M downstream along the gate plate 104. The liquid M enters through the liquid inlet holes 120 having a circular cross-section which are formed in the gate plate 104, and through the gate rail insertion hole 122 or elsewhere, and pass the liquid flow passage 130 which is formed between the sub-plate 123 and the gate plate 104. After that, as FIG. 10 shows, it drops down smoothly into the liquid storage concave section 160 by way of the liquid outlet hole 153 formed facing towards the liquid discharge passage 142, and the liquid guide protrusion 153*b*, and is discharged immediately and swiftly to outside the device 200 by way of the liquid discharge passage 142. It should be added that, as may be seen from FIG. 10, liquid which has overflowed from the aperture 160*a* of the liquid storage concave section 160 also drops down into the liquid storage concave section 160 by way of the slit 160*b* formed on the rear surface of the aperture 160*a*, and is swiftly discharged to outside the device 200 by way of the liquid discharge passage 142.

Consequently, in the coin handling device 200 to which the above second embodiment pertains, some of the liquid J introduced through the coin insertion aperture A flows downstream as liquid M along the gate plate 104, and is guided directly into the liquid discharge passage 142 by way of the liquid flow passage 130, through which large amounts of liquid are allowed to pass. It is then swiftly discharged, allowing the process of discharging the liquid to be implemented with even greater speed.

In other words, the coin handling device 200 to which the second embodiment of the second invention pertains has a coin-sorting unit 201, coin guide means 181 comprising the coin passage 106 and serving to guide coins inserted by way of the coin insertion aperture A downwards roughly vertically, liquid collecting means 182 comprising the liquid collection unit 140 and serving to collect liquid dropping down the coin guide means 181, and liquid discharging means 183 comprising the liquid discharge passage 142 and serving to discharge the collected liquid to outside the device, being further equipped with liquid flow-in means 184, comprising the liquid inlet hole 121 and allowing liquid dropping down the coin guide means 181 to flow into the coin-sorting unit 201 rather than into the liquid collecting means 182, liquid passing means 185, comprising the liquid flow passage 130 and allowing large amounts of the liquid which has been allowed to flow in to pass, and liquid flow-out means 216, comprising the liquid outlet hole 153 and the liquid guide protrusion 153*b*, and allowing the liquid which has been allowed to pass to flow out to the liquid discharging means 183. As a result, even supposing detergent or a similar viscous liquid is poured into the coin insertion aperture A in large amounts, it is swiftly discharged to outside the device by way of the liquid flow passage 130 formed on the rear surface of the gate plate, making it possible to prevent, as far as is feasible, the liquid from overflowing from the coin passage 106 which connects directly to the coin insertion aperture A.

Moreover, no liquid guide groove is formed on the gate plate 104, one of the plates constituting the coin passage 106 in the coin sorting unit 201. Thus, it can be ensured that when the main plate 103 and the gate plate 104 are opened in order to return coins which have lodged between them, it is possible to do so and return the coins without any of them becoming wedged between the main plate 103 and the gate plate 104, thus providing a coin handling device having a stable function for the return of lodged coins.

It should be added that of the first and second embodiments of the second invention, the first embodiment as illustrated in FIG. 9 has liquid discharging means which comprises the liquid outlet hole 121 formed at the bottom of the liquid flow passage 130 and allowing the liquid M to flow out towards the liquid collection unit 140, while in the second embodiment as illustrated in FIG. 10 it comprises the liquid outlet hole 153 formed at the bottom of the liquid flow passage 130 and allowing the liquid M to flow out towards the liquid discharge passage 142, and the liquid guide protrusion 153*b* which guides the liquid M. However, this second invention is in no way restricted to the first and second embodiments, and it is possible, for instance, for the liquid discharging means to comprise the liquid outlet hole 121 illustrated in the first embodiment and a liquid guide protrusion which guides the liquid M towards the liquid collection unit 140. Similarly, it is possible to omit the liquid guide protrusion 153*b* illustrated in the second embodiment, and for the liquid discharging means to comprise only the liquid outlet hole 153.

It is also possible for the liquid discharging means to comprise both a liquid outlet hole 121 formed at the bottom of the liquid flow passage 130, and a liquid outlet hole 153 also formed at the bottom of the liquid flow passage 130 and allowing the liquid M to flow out towards the liquid discharge passage 142. What is more, it is also possible to form a liquid guide protrusion which guides the liquid towards the liquid collection unit 140, and a liquid guide protrusion 153*b* which guides the liquid M towards the liquid discharge passage 142.

Moreover, in the coin handling device 100, 200 to which the first and second embodiments pertain, liquid flow-in means 184 and liquid flow-out means 186 have been formed on the gate plate 104, one of the plates constituting the coin passage 106 which is the coin guide means 181 in the coin sorting unit 101, 201, and no liquid guide groove has been formed. However, in this second invention all that is required is that no liquid guide groove be formed on at least one of the plates constituting the coin passage 106 which is the coin guide means 181, and it is also possible, for instance, to form the liquid flow-in means 184 on the main plate 103, the liquid flow-out means 186 on the gate plate 104, and no liquid guide groove.

As has been explained above, the coin handling device 200 to which the second invention pertains has at least a coin sorting unit 101, 201 comprising coin guide means 181 which serves to guide coins inserted by way of the coin insertion aperture A downwards roughly vertically, liquid collecting means 182 which serves to collect liquid dropping down the coin guide means 181, and liquid discharging means 183 which serves to discharge the collected liquid to outside the device, the coin sorting unit 101, 201 being equipped with liquid flow-in means 184 which allows liquid dropping down the coin guide means 181 to flow into the coin-sorting unit 101, 201 rather than into the liquid collecting means 182, liquid passing means 185 which allows large amounts of the liquid having been allowed to flow in to pass, and liquid flow-out means 186, 216 which allows the liquid having been allowed to pass to flow out to the liquid discharging means 183. As a result, even supposing detergent or a similar viscous liquid is poured into the coin insertion aperture A in large amounts, it is swiftly discharged to outside the device, making it possible to prevent, as far as is feasible, the liquid from overflowing from the coin guide means 181. In this manner it is possible to prevent, as far as is feasible, liquid from adhering to the various pieces of sorting machinery within the coin handling device 101, 201, thus providing a coin handling device which is endowed with continuous stable functioning.

Moreover, no liquid guide groove is formed on at least one plate from among the main plate 103 and the gate plate 104, which constitute the coin guide means 181. Thus, it can be ensured that when the main plate 103 and the gate plate 104 are opened in order to return coins which have lodged between them, it is possible to do so and return the coins without any of them becoming wedged between the main plate 103 and the gate plate 104, thus providing a coin handling device having a stable function for the return of lodged coins.

INDUSTRIAL APPLICABILITY

As has been explained above, the coin handling device to which the first and second inventions pertain is effective as a coin handling device for use in automatic vending machines, money changing machines, self-service machines and elsewhere, which sorts and stores inserted coins according to their denomination, and dispenses the sorted and stored coins as change.

In particular, the coin handling device to which the first invention pertains has succeeded in preventing, as far as is feasible, liquid dropping down along the cable and through the cable guide hole from adhering to the various components within the body of the device, and is thus suited for use as a coin handling device which will function in a stable fashion over long periods of time, and guard effectively against pranks involving the pouring of liquid into it.

Similarly, the coin handling device to which the second invention pertains has succeeded in preventing, as far as is feasible, liquid from adhering to the various pieces of sorting machinery within the coin handling device, thus providing a coin handling device which is endowed with continuous stable functions of sorting coins and returning lodged coins.

What is claimed is:

1. A coin handling device having at least a cable (20) for feeding various signals and electric power; a body (2) of the device comprising a casing, an upper surface (10) of the casing being formed with a cable guide hole (10*a*) into which the cable (20) is inserted; and a coin-sorting unit (5) provided within the body (2) of the device, for sorting inserted coins into authentic ones and counterfeit ones, characterized by comprising:

liquid guide means (61) for guiding any liquid dropping down the cable (20) and through the cable guide hole (10*a*) into the body (2) of the device;

liquid storing means (62) for storing the guided liquid within the body (2) of the device; and liquid discharging means (63) for discharging the stored liquid from the body (2) of the device.

2. The coin handling device according to claim 1, characterised in that:

the liquid storing means (62) comprises a liquid storage box (30) including a box (31) having a cross-section substantially in the form of three sides of a rectangle;

the liquid guide means (61) comprises:

a roughly U-shaped cable bend (20*b*) formed at an upper end of the cable (20); and a lid (32) for covering an upper surface of the box (31), a slit (33) being formed into which the cable bend (20*b*) is inserted, the lid (32) being formed in such a manner as to incline towards the slit (33), and the liquid discharging means (63) is formed on the side of a bottom of the liquid storage box (30), and comprises a liquid discharge outlet (31*b*) connected to the rear surface (12) of the body (2) of the device, whereby liquid dropping down the cable (20) and through the cable guide hole (10*a*) is guided by the slit (33) and the lid (32) into the liquid storage box (30) where it is stored and then discharged by way of the liquid discharge outlet (31*b*) to a rear surface (12) of the body (2) of the device.

3. A coin handling device having a coin-sorting unit (101, 201) comprising coin guide means (181) for guiding coins inserted by way of a coin insertion aperture (A) downwards substantially vertically, liquid collecting means (182) for collecting liquid dropping down through the coin guide means (181), liquid discharging means (183) for discharging the collected liquid to outside the device, liquid passing means (185) for allowing large amounts of the liquid to pass, liquid flow-in means (184) for allowing liquid dropping down through the coin guide means (181) to flow into the liquid passing means (185), and liquid flow-out means (186, 216) for allowing the liquid which has been passed through the liquid passing means (185) to flow out to the liquid discharging means (183), characterized in that:

the coin guide means (181) comprises a coin passage (106) connected directly to the coin insertion aperture (A), the coin passage defined by a main plate (103) and a gate plate (104) for opening and closing the main plate (103), and;

the liquid collecting means (182) comprises a liquid collecting unit (140) for collecting liquid dropping down through the coin passage (106) formed solely from a portion of the main plate (103) located beneath the coin passage (106), and;

the liquid discharging means (183) comprises a liquid discharge passage (142) connected to the liquid collecting unit (140);

the liquid flow-in means (184) comprises a liquid inlet hole (120) disposed in an upstream portion of the coin passage (106);

the liquid flow-out means (186, 216) comprises a liquid outlet hole (121, 153) or a liquid guide protrusion (153*b*), disposed in a downstream portion of the coin passage (106); and the liquid passing means (185) comprises a liquid flow passage (130) disposed on a rear surface of the coin passage (106), for allowing large amount of liquid flowing from the liquid inlet hole (120) to the liquid outlet hole (121,153) or the liquid guide protrusion (153*b*) to pass.

4. The coin handling device according to claim 3, characterized in that:

the liquid flow-in means (184) and the liquid flow-out means (186, 216) are located on the gate plate (104); and the liquid passing means (185) is located on a rear surface of the gate plate (104).

5. The coin handling device according to claim 3, characterised in that the liquid flow-out means (186) is located facing towards the liquid collecting means (182) so that liquid dropping down from the liquid flow-out means (186) is discharged by way of the liquid collecting means (182) and through the liquid discharging means (142).

6. A coin handling device having at least a coin-sorting unit (101, 201) comprising coin guide means (181) for guiding coins inserted through a coin insertion aperture (A) downward substantially vertically, liquid collecting means (182) for collecting liquid dropping down the coin guide means (181), and liquid discharging means (142, 183) for discharing the collected liquid to outside the device, characterized in that the coin-sorting unit (101, 210) comprises:

liquid flow-in means (184) for allowing liquid dropping down the coin guide means (181) to flow into the coin-sorting unit (101, 201) rather than into the liquid collecting means (182);

liquid passing means (185) for allowing large amounts of the liquid which has been allowed to flow into the coin-sorting unit (101, 201) to pass; and liquid flow-out means (186, 216) for allowing the liquid which has been allowed to pass to flow out to the liquid discharging means, characterized in that the liquid flow-out means (216) is located facing towards the liquid discharging means (142, 183) so that liquid dropping down from the liquid flow-out means (186) is discharged through the liquid discharging means (142) without passing through the liquid collecting means (182).

7. A coin handling device having at least a coin-sorting unit (101, 201) comprising coin guide means (181) for guiding coins inserted through a coin insertion aperture (A) downward substantially vertically, liquid collecting means (182) for collecting liquid dropping down the coin guide means (181), and liquid discharging means (142, 183) for discharging the collected liquid to outside the device, characterized in that the coin-sorting unit (101, 210) comprises:

liquid flow-in means (184) for allowing liquid dropping down the coin guide means (181) to flow into the coin-sorting unit (101, 201) rather than into the liquid collecting means (182);

liquid passing means (185) for allowing large amounts of the liquid which has been allowed to flow into the coin-sorting unit (101, 201) to pass; and liquid flow-out means (186, 216) for allowing the liquid which has been allowed to pass to flow out to the liquid discharging means, characterized in that the liquid flow-out means (186, 216) is located facing respectively towards the liquid collecting means (182) and the liquid discharging means (142) so that liquid dropping down from the liquid flow-out means (186, 216) is discharged by way of the liquid collecting means (182) and through the liquid discharging means (142), and also through the liquid discharging means (142) without passing through the liquid collecting means.

* * * * *